US007123868B2

(12) United States Patent
Schultheis et al.

(10) Patent No.: US 7,123,868 B2
(45) Date of Patent: Oct. 17, 2006

(54) ELECTROPHOTOGRAPHIC PRINTING DEVICE HAVING NON-GROUNDED ELECTRICALLY CONDUCTIVE LAYER

(75) Inventors: Bernd Schultheis, Schwahenheim (DE); Holger Köbrich, Flörsheim (DE); Rainer Solbach, Langenbach (DE); Hans-Jürgen Hommes, Herkersdorf (DE); Dieter Jung, Daaden (DE)

(73) Assignee: Schott AG, Mainz (DE)

( * ) Notice: Subject to any disclaimer, the term of this patent is extended or adjusted under 35 U.S.C. 154(b) by 152 days.

(21) Appl. No.: 10/487,389

(22) PCT Filed: Aug. 19, 2002

(86) PCT No.: PCT/EP02/09247

§ 371 (c)(1),
(2), (4) Date: Jul. 7, 2004

(87) PCT Pub. No.: WO03/021362

PCT Pub. Date: Mar. 13, 2003

(65) Prior Publication Data

US 2004/0240911 A1 Dec. 2, 2004

(30) Foreign Application Priority Data

Aug. 31, 2001 (DE) ..... 101 42 443

(51) Int. Cl.
*G03G 15/16* (2006.01)

(52) U.S. Cl. ..... 399/297; 399/303

(58) Field of Classification Search ..... 399/297, 399/298, 301, 302, 303, 310, 311, 312
See application file for complete search history.

(56) References Cited

U.S. PATENT DOCUMENTS

| | | | | |
|---|---|---|---|---|
| 4,674,860 | A * | 6/1987 | Tokunaga et al. | 399/303 |
| 5,136,336 | A * | 8/1992 | Dastin et al. | 399/304 |
| 5,189,479 | A * | 2/1993 | Matsuda et al. | 399/300 |
| 5,909,611 | A * | 6/1999 | Iwakura | 399/302 |
| 6,228,448 | B1 * | 5/2001 | Ndebi et al. | 428/36.91 |
| 6,487,386 | B1 * | 11/2002 | Zimmer et al. | 399/297 |

FOREIGN PATENT DOCUMENTS

| | | |
|---|---|---|
| DE | 198 419 500 A1 | 5/2000 |
| JP | 58063967 A | 4/1983 |

* cited by examiner

*Primary Examiner*—Hoan Tran
(74) *Attorney, Agent, or Firm*—Pauley Petersen & Erickson

(57) ABSTRACT

An electrophotographic printing device including a toner-developer unit, a lighting device, a developer drum, a photoconductor, a transfer unit and an earthed charging device. The substrate to be printed is placed on a transport device and moved along the transfer unit and the toner image of the transfer unit is transmitted to the substrate. A clear, sharp and shadow-free printed image is obtained by arranging the substrate on a non-earthed, electrically conductive layer which is insulated relative to the earthed transport device by an insulator extending along the charging device that is located above the substrate and the measurement of substrate that is to be printed and that is oriented in the direction of transport. The charging device can be charged at a potential, exciting voltage $U_F$, of between 1 to 10 kV, more particularly 1.5 to 4 kV.

27 Claims, 4 Drawing Sheets

ELECTROPHOTOGRAPHIC PRINTING DEVICE HAVING NON-GROUNDED ELECTRICALLY CONDUCTIVE LAYER

BACKGROUND OF THE INVENTION

1. Field of the Invention

This invention relates to an electrophotographic printing device with a toner developer unit, an exposure device, a developer drum, a photo-conductor, a transfer unit and a grounded charging device, wherein the substrate to be imprinted is moved, lying on a transport device, beyond the transfer zone of the transfer unit and the toner image of the transfer unit is transferred to the substrate.

2. Discussion of Related Art

A printing device is known from German Patent Reference DE 198 49 500 A1. The developer unit operates with a toner and is assigned to a photo-conductor drum. The surface of the photo-conductor drum is activated by an exposure device so that an application of toner to it becomes possible. The photo-conductor drum is connected via a contact line with a transfer roller. The transfer roller rolls off on the surface of the substrate to be imprinted and is transferred to the top of the substrate facing the transfer unit, using an electrostatic charge of the substrate.

Two transfer operations of the toner image occur in this printing device. The first transfer operation is created during the transfer from the photo-conductor drum to the transfer roller, and the second transfer operation during the transfer of the toner to the substrate. There is no complete transfer of the toner during each of the transfer operations. The achievement of as high as possible a rate of transfer should be attempted so that clear printed images with sharp contours are created. Thus the even and sufficient formation of the charge image in the area of the surface of the substrate, such as the charge transfer from the charging device to the substrate, is important.

Insufficient charging occurs in particular with thick substrates of a material with poor electrical conducting properties.

SUMMARY OF THE INVENTION

It is one object of this invention to provide a printing device of the type mentioned above but wherein an effective and even toner transfer to the surface of the substrate occurs regardless of the thickness of the material and of the nature of the substrate, and inhomogeneous areas in the printed image, such as formation of shadows, are prevented.

In accordance with this invention this object is achieved with an insulator arranged between the grounded transport device and the substrate, and an electrically conductive layer between the substrate and the insulator, which extends over the charging device located above the substrate and the dimension of the substrate to be imprinted.

To improve the toner transfer, the electrically conductive layer between the substrate and the insulator is charged to a potential, such as a field voltage $U_F$, to ground of 1 to 10 kV, typically between 1.4 and 4 kV. The electrically conductive layer is insulated against the conveying device.

Even with electrically non-conductive substrates, such as glass plates, glass-ceramic plates or plastic plates, an even and sufficient charging of the surface of the substrate is achieved with the substrate seated insulated on the transport device and the insulator arranged between the substrate and the transport device, if a continuous metallic layer is also arranged between the substrate and the insulator, which extends in the transport direction at least over the charging device and the dimension of the substrate oriented in the transport direction. Thus a homogeneous field can be generated in the process, which is not impaired by the transport device when connected to a potential corresponding to the reference potential of the charge.

In this case the charging device is preferably embodied so that the charging device is divided into a partial charging device located upstream and downstream of the transfer zone, viewed in the transport direction, which are placed into grounded housings open in the direction toward the substrate.

With this design of the printing device, the substrate to be imprinted is first brought to the partial charging device upstream of the transfer unit and is electrostatically charged on its surface in the process, before it is brought to the transfer zone. The toner transfer occurs in the transfer zone. During the continuing transport of the substrate it can occur, depending on the size of the substrate and of the printed image, that the toner transfer to the substrate is not yet complete, but the substrate has already left the partial charging device located upstream of the transfer zone. In this case the partial charging device located downstream of the transfer zone prevents a drop of the charge by recharging the substrate. An even and effective toner transfer over the entire transport path of the substrate is assured by a homogeneous charge.

With a segmented insulator it is possible to provide a potential balance between the individual segments, which improves printing results.

Transporting of the substrates can be performed so that a table-like transport device is employed, which can be linearly moved beyond the transfer zone and is covered by a one-piece insulating plate, or one divided into segments, as the insulator. The segments or the one-piece insulating plate each is provided with a conductive layer, for example a metal layer, on the top facing the substrate.

If functional elements are housed in the transport device, which contact the substrate, for example aspirating openings, grooves, transport elements, sensors, cable conduits or other components, a further embodiment provides that the table-like transport device supports functional elements, which are conducted through the segments or the one-piece insulating plate, as well as through the conductive layer, and are connected in an electrically conducting manner with the conductive layer, but are electrically insulated against the transport device.

Thus inhomogeneities in the charge in the area of the functional elements are prevented, which might interfere with the toner transfer near or in the area of the functional elements.

The functional elements end flush with the conductive layer, which is achieved, for example, by a resilient support of the functional elements on the transport device and leads to their resting flush against the underside of the substrate.

In accordance with one embodiment, the transporting of the substrates can also occur so that the transport device has an endless conveyor belt, which is embodied as a metallic belt or has a metallic layer on the exterior supporting the substrates. The endless conveyor belt is conducted over reversing rollers embodied as insulators, and the endless conveyor belt can be moved between the reversing rollers on an insulating plate covering the transport framework.

Transporting of the substrates can occur continuously without it being necessary to move the machine framework.

The build-up of a homogeneous and sufficient charge of the substrates also remains assured with this embodiment of the transport device.

In order to provide the charge in the same way, transverse with respect to the transport direction, in one embodiment the charging device is designed in the form of area coronas, which extend over an entire width of the surface of the substrate extending transversely to the transport direction, and at least partly over the surface of the substrate oriented in the transport direction. Area coronas contain electrically non-conductive corona wire holders, which are stretched in grounded housings and on which several side-by-side arranged electrically conductive corona wires are supported, which have a uniform charge potential, with a counter-potential that is grounded.

The printing device is also constructed so that the two partial charging devices have a spacing which is less than the extension of the surface of the substrate to be imprinted in the transport direction.

The above described electrically conductive layer has a thin aluminum or copper foil. Thin sheets or foils of steel, and also plastic foils of polyurethane, silicon, and the like, which have been made electrically conductive, are also suitable. The electrical conductivity of the layer must be sufficiently large with respect to the insulator. Resistances of less than 1000 $\Omega/cm^2$ are advantageous.

Materials made of highly impact-resistant plastics, such as polyamide, polyimide, epoxy resins, resin-impregnated paper, bakelite, are suitable as insulators.

In accordance with a further embodiment, the insulator can also be of an abrasion-resistant and mechanically stressable ceramic or silicate material, such as $Al_2O_2$, or of thin glass.

In accordance with one preferred embodiment, the metallic layer is of an aluminum or copper foil, thin sheet metal, steel foil or plastic foils of polyurethane, silicon, and the like, which are made electrically conductive, and which have an electrical conductivity of less than 1000 $\Omega/cm^2$.

The metallic layer and the insulator can also be combined into a unit and can be of an epoxy resin plate coated with copper.

In accordance with a further embodiment, the conductive layer can also be provided so that a resilient support with a conductive or metallized surface is applied to the insulator of the transport device, which leads to an even adherence of the substrate underside. Segmentation of the support is also possible if the segments are connected with each other in an electrically conducting manner. To achieve an effective transfer, the conductive surface of the support is charged to a potential, such as a field voltage $U_F$, to ground of 1 to 10 kV, in particular between 3.5 and 5 kV. The surface resistance of the elastic support and the resistance of the functional elements embedded in the transport device, such as endless conveyor belts, for example, should preferably be matched to each other, because this results in a homogeneous charging of the substrate.

To achieve an improved insulation between the substrate to be charged and the transport device, in a further embodiment of the printing device the substrate to be imprinted is placed into a mold matched to the size of the substrate. The mold is made of an electrically insulating material, the surface of the mold facing the substrate underside is electrically conductive or has an electrically conductive layer, or metal plate. The electrically conductive layer, or metal plate, is charged to a potential, such as a field voltage $U_F$, to ground of 1 to 10 kV, in particular between 1.5 and 4 kV, via wiper contacts arranged directly upstream and downstream of the charging device located above the substrate.

BRIEF DESCRIPTION OF THE DRAWINGS

This invention is explained in view of exemplary embodiments represented in the drawings, wherein.

DESCRIPTION OF PREFERRED EMBODIMENTS

Figure 1:
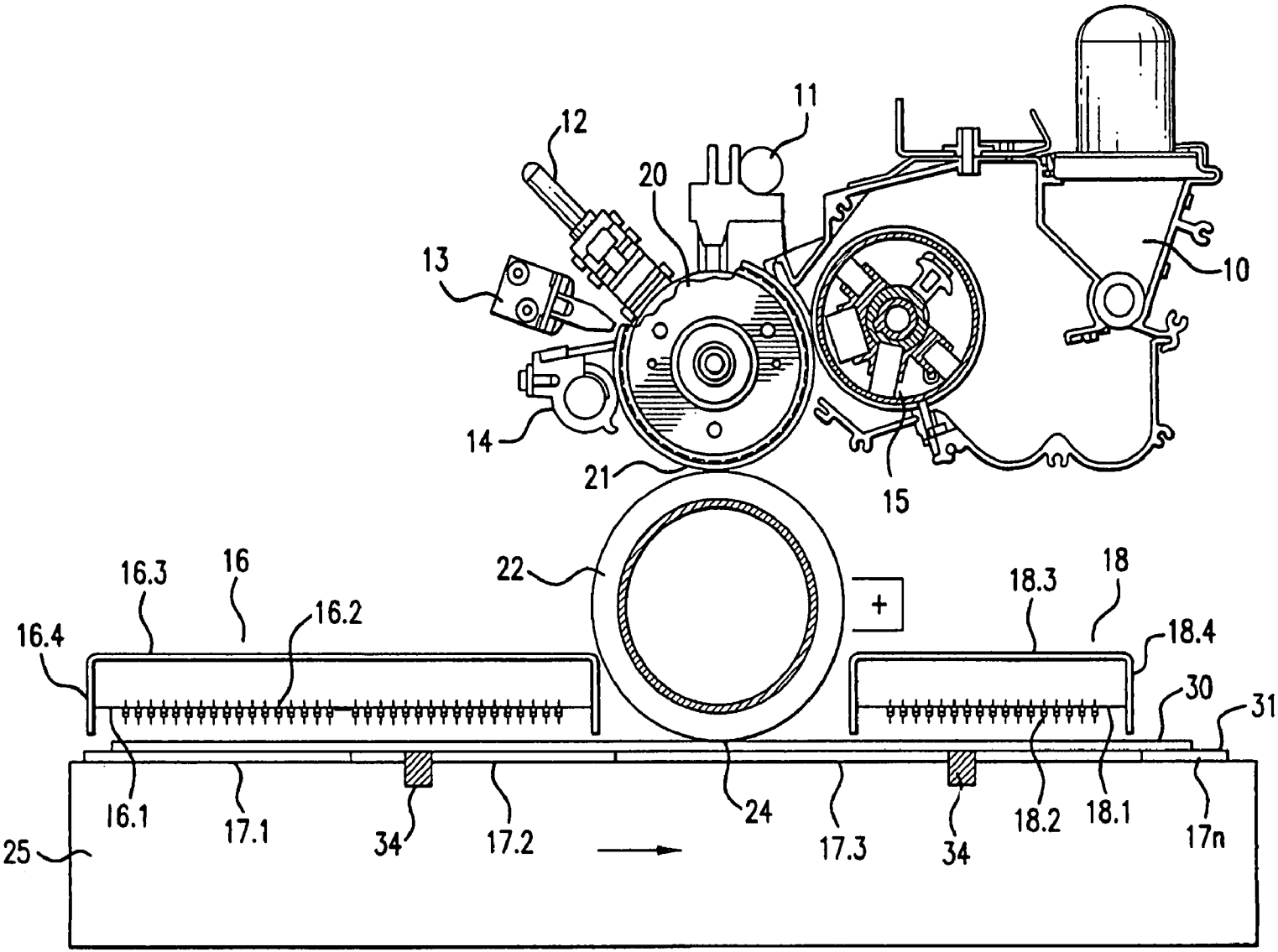
FIG. 1 is a front view of a printing device with a linearly movable transport device.

An electrophotographic printing device for plate-shaped substrates 30 is shown in a lateral view and partially in section in FIG. 1. The substrate 30 is moved linearly past or beyond a transfer zone 24 of a transfer unit by a table-like transport device 25. Here, an intermediate layer consisting of an insulator 17, or segments 17.1 to 17.n thereof, is located between the underside of the substrate 30 and the support surface of the transport device. Charging of the substrate 30 occurs via a partial charging device 16 arranged upstream of the transfer unit in the transporting direction, and a partial charging device 18, arranged downstream of the transfer unit, which maintain a number of electrically conductive corona wires stretched on non-conductive corona wire holders in housings. The partial charging devices 16 and 18 are embodied as area coronas and extend transversely over the entire width of at least the substrates 30 to be imprinted.

The top of the insulator plate 17, or of the segments 17.1 to 17.n, facing the underside of the substrates 30, has a metallic layer 31.

Figure 2:
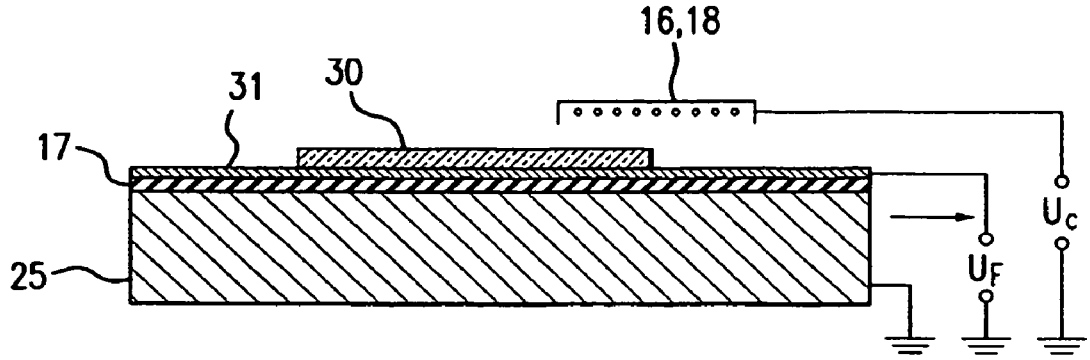
FIG. 2 schematically shows a potential distribution during electrical charging of a substrate.

As shown in FIG. 2, the transport device 25 is grounded, such as connected with the counter-potential of the charge voltage $U_C$. Therefore the corona wires of the partial charging devices 16 and 18 are uniformly connected to the potential of the charge voltage $U_C$. The metallic layer 31 of the insulator 17, or of the segments 17.1 to 17.n, remains free of potential or, for the further improvement of the toner transfer, is charged with a voltage ($U_F$) to ground of 1 to 10 kV, in particular between 3.5 and 5 kV.

The transfer unit contacts the substrate 30 near or in the area of the transfer zone for the toner transfer, wherein the transport speed of the substrate 30 is matched or coupled to the speed of rotation of the transfer unit so that no slippage occurs between them.

As also shown in FIG. 1, it is possible to integrate functional elements 34 into the transport device 25, which contact with the undersides of the substrates 30 to be imprinted through the insulator 17.

Figure 3:
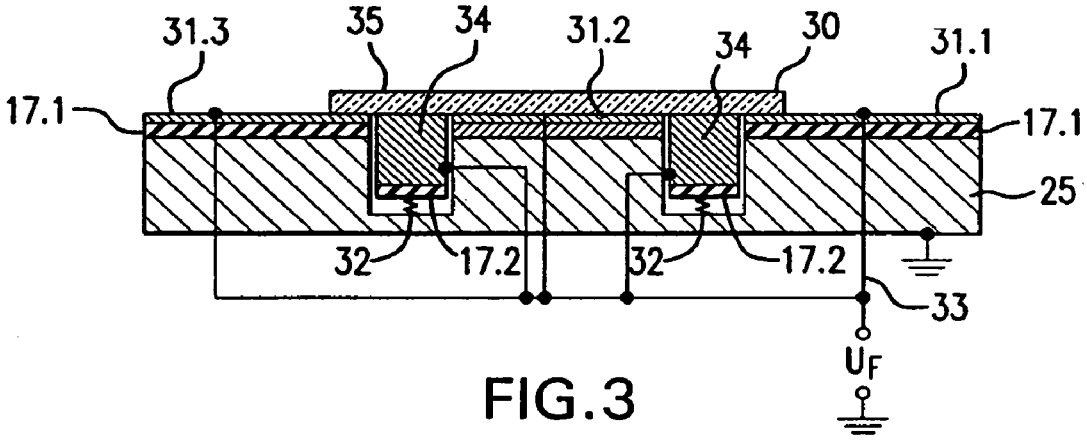
FIG. 3 is a sectional view of a linearly movable transport device with functional elements which are in contact with the substrate.

The functional elements 34 can be aspirating openings, grooves, transport elements, sensors, cable conduits or other components, which preferably are flush with the top of the metallic layer 31 and, where required, are maintained with spring tension against the underside of the substrate 30 by springs 32, as shown in FIG. 3. In this case the functional elements 34 can be connected by potential balancing lines 33 with the reference potential of the charge voltage $U_C$ and the metallic layer 31, however, they are maintained electrically insulated in the transport direction, as shown by the small air gap. The transport devices 25 can pass one after the other through the transfer zone and each can be occupied with one or several substrates 30 to be imprinted.

The parts of an electrophotographic printing device, which per se and in its functioning is known, are briefly presented in FIG. 1.

A toner, for example a ceramic, a thermoplastic or a duromeric plastic toner is stored in a developer unit 10. A developer drum 15 is assigned to the developer unit 10, which conducts the toner to a photo-conductor 20. The photo-conductor 20 is embodied in a roller shape and is in linear contact with the transfer unit 22 in a contact zone 21. A coating unit 11 is arranged above the photo-conductor 20, which exposes a light-sensitive layer at the circumference of the photo-conductor 20. A latent electrostatic charge image is thus created. Based on the charge image, toner particles are transferred by electrostatic processes from the developer drum 15 to the layer of the photo-conductor 20. These toner particles are passed on to the transfer unit 22 in the area of the contact zone 21. A cleaning device 14, which is arranged downstream with respect to the direction of rotation of the photo-conductor 20, removes still adhering toner remnants from the photo-conductor 20. A quenching light 13 follows the cleaning device 14, which discharges the photosensitive layer of the photo-conductor 20. Thereafter the photosensitive layer of the photo-conductor 20 is again brought to the uniform charge structure, so that it can again be provided with an electrostatic charge image by the exposure unit 11.

The transfer unit rolls off on the substrate 30 to be imprinted. In the process, the toner on the transfer unit is transferred to the substrate 30 in the transfer zone. Because the partial charging devices 16 and 18 cause a full-area charge of the substrate 30 with opposite potential with respect to the charge on the photo-conductor 20, an unequivocal toner transfer with a high degree of effectiveness takes place.

As shown in FIG. 1, the distance in the transport direction between the partial charging devices 16 and 18 is less than the dimension of the substrate in this direction, so that the substrate 30 remains charged during its entire passage through the transfer zone.

Figure 4:
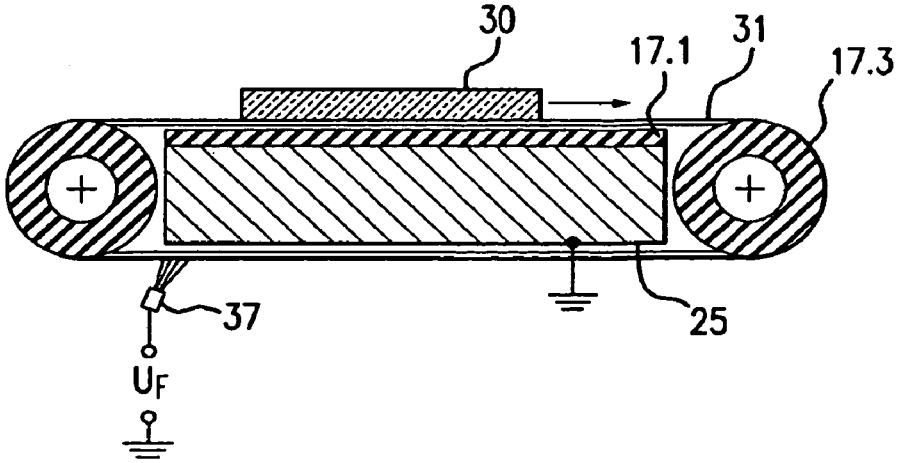
FIG. 4 is a schematic sectional view of a transport device embodied as an endless conveyor belt.

FIG. 4 shows a transport device 25, which is grounded and has an endless conveyor belt between two reversing rollers, which belt is electrically conductive and forms the conductive layer 31. The reversing rollers form an insulator 17.3, which can also be formed by reversing rollers with an insulating circumferential layer, for example a PTFE layer. The base of the reversing rollers can also be made of an insulating material. The additional voltage is supplied for example via additional wiper contacts 37.

The endless conveyor belt can be a close-meshed metal belt, which simplifies fixing in place the substrate 30 by suction.

Figure 5:
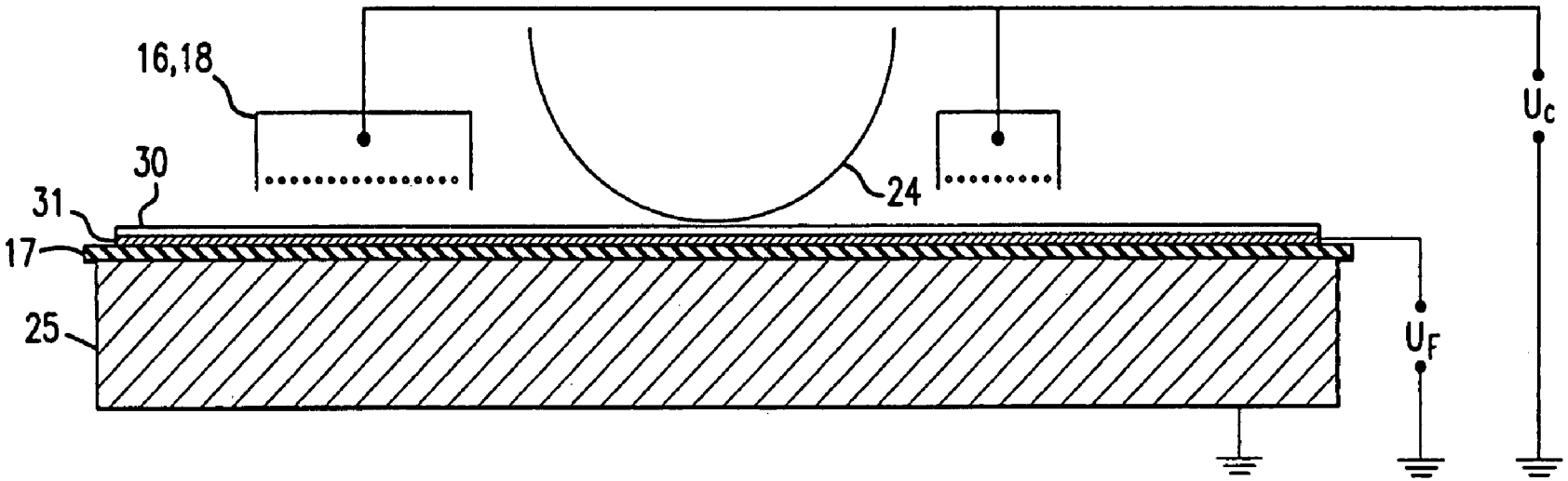
FIG. 5 is a schematic diagram showing an additional potential for electrostatically charging the substrate and the conductive layer.

Similar to FIG. 2, FIG. 5 shows a grounded transport device 25 with an insulator 17 arranged on it. The electrically conductive layer 31 between the substrate 30 and the insulator 17 is charged by a field voltage $U_F$ to 1 to 10 kV, in particular between 1.5 and 4 kV. The charging devices 16 and 18, as well as the transfer zone 24 above the substrate 30 are embodied and arranged the same as shown in FIG. 2.

Figure 6:
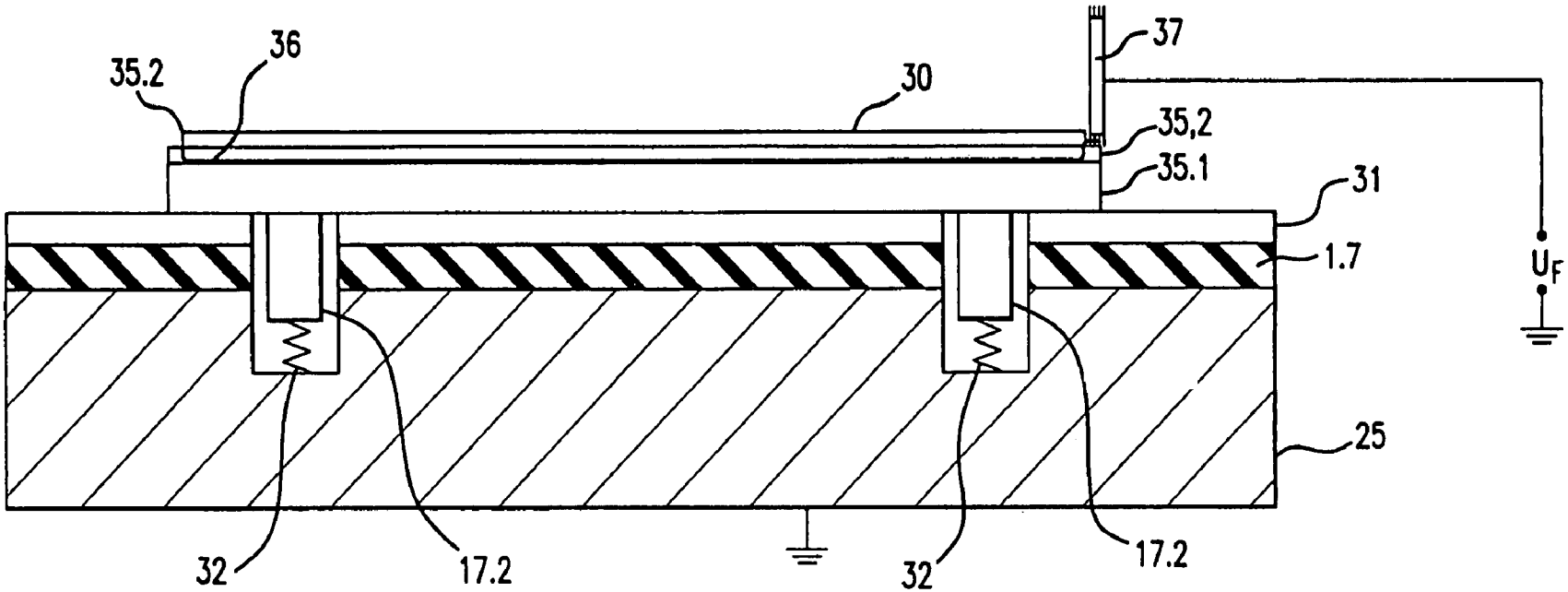
FIG. 6 is an enlarged schematic diagram of an insulated substrate support plate for electrostatic charging via wiper contacts.

As shown in FIG. 6, the substrate 30 can also be received in an insulated mold 35.1 with rims 35.2. The mold can be arranged on an electrically conducting layer 31, which is separated via an insulator 17 from the grounded transport device 25, but is transported with it. The receptacle of the mold 35.1 has an electrically conductive surface 36, which has the field voltage $U_F$ by wiper contacts 37.

The invention claimed is:

1. An electrophotographic printing device with a toner developer unit (10), an exposure device (11), a developer drum (15), a photo-conductor (20), a transfer unit (22) and a grounded charging device (16, 18), wherein a substrate (30) to be imprinted is moved, lying on a transport device, beyond a transfer zone (24) of the transfer unit (22) and a toner image of the transfer unit (22) is transferred to the substrate (30), the electrophotographic printing device comprising:

during the printing process arranging the substrate (30) on a non-grounded, electrically conductive layer (31) which is insulated against the grounded transport device (25) by an insulator (17, 17.1 . . . 17.n, 17.3) extending over the charging device (16, 17) located above the substrate (30) and a dimension, oriented in a transport direction, of the substrate (30) to be imprinted.

2. The electrophotographic printing device in accordance with claim 1, wherein the charging device (16, 18) is divided into two partial charging devices (16 and 18) located upstream and downstream of the transfer zone, viewed in the transport direction, which are placed into grounded housings that are open toward the substrate (30).

3. The electrophotographic printing device in accordance with claim 2, wherein the transport device (25) is formed as a table and can be linearly moved beyond the transfer zone and is covered by one of a one-piece and a segmented insulating plate as the insulator (17, 17.1 . . . 17.n), and the or one of the one-piece and the segmented insulating plate (17) has a conductive layer (31) on a top facing the substrate (30).

4. The electrophotographic printing device in accordance with claim 2, wherein the transport device (25) supports functional elements (34) which are conducted through the conductive layer (31), and are connected in an electrically conducting manner with the functional elements (34), but are electrically insulated against the transport device (25).

5. The electrophotographic printing device in accordance with claim 2, wherein the transport device (25) has an endless conveyor belt one of embodied as a metallic belt and having a metallic layer on an exterior supporting the substrate (30), the endless conveyor belt is conducted over reversing rollers embodied as insulators (17.3), and the endless conveyor belt (25) is movable between the reversing rollers on the insulator (17.1) covering a transport framework.

6. The electrophotographic printing device in accordance with claim 5, wherein the charging device (16, 18) is designed as area coronas which extend over an entire width of a surface of the substrate (30) extending transversely to the transport direction, and at least partly over the surface of the substrate (30) oriented in the transport direction.

7. The electrophotographic printing device in accordance with claim 6, wherein the area coronas contain electrically non-conductive corona wire holders (16.1, 18.1) which are stretched in grounded housings (16.3, 16.4, or 18.3, 18.4) and on which several side-by-side arranged electrically conductive corona wires (16.2, 18.2) are supported, which have a uniform charge potential ($U_C$) with a counter-potential that is grounded.

8. The electrophotographic printing device in accordance with claim 2, wherein the two partial charging devices (16, 18) have a distance which is less than an extension of the surface of the substrate (30) to be imprinted in the transport direction.

9. The electrophotographic printing device in accordance with claim 8, wherein the insulator (17, 17.1 . . . 17.n, 17.3) is of at least one of a highly impact-resistant plastic, a polyamide, a polyimide, an epoxy resin, a resin-impregnated paper, and a bakelite.

10. The electrophotographic printing device in accordance with claim 9, wherein the insulator (17, 17.1 . . . 17.n, 17.3) is of an abrasion-resistant and mechanically stressable ceramic or silicate material.

11. The electrophotographic printing device in accordance with claim 10, wherein the electrically conductive layer (31) is of at least one of an aluminum foil, a copper foil, a thin sheet metal, a steel foil and plastic foils of polyurethane, silicon, and the like, which are electrically conductive, and which have an electrical conductivity of less than 1000 $\Omega/cm^2$.

12. The electrophotographic printing device in accordance with claim 10, wherein an epoxy resin plate coated with copper is used as the insulator (17) and the electrically conductive layer (31).

13. The electrophotographic printing device in accordance with claim 12, wherein the electrically conductive layer (31) between the substrate (30) and the insulator (17) is chargeable to a potential voltage of 1 to 10 kV.

14. The electrophotographic printing device in accordance with claim 13, wherein the electrically conductive layer (31) is embodied as an elastic endless belt made of one of a conductive material and a metallized surface.

15. The electrophotographic printing device in accordance with claim 14, wherein the substrate (30) is receivable in an insulating mold (35.1) having rims (35.2) with a receptacle that supports a conductive layer (36) which can be charged to the field voltage ($U_F$) by brushes (37).

16. The electrophotographic printing device in accordance with claim 1, wherein the transport device (25) is formed as a table and can be linearly moved beyond the transfer zone and is covered by one of a one-piece and a segmented insulating plate as the insulator (17, 17.1 . . . 17.n), and the one of the one-piece and the segmented insulating plate (17) has a conductive layer (31) on a top facing the substrate (30).

17. The electrophotographic printing device in accordance with claim 1, wherein the transport device (25) supports functional elements (34) which are conducted through the conductive layer (31), and are connected in an electrically conducting manner with the functional elements (34), but are electrically insulated against the transport device (25).

18. The electrophotographic printing device in accordance with claim 1, wherein the transport device (25) has an endless conveyor belt one of embodied as a metallic belt and having a metallic layer on an exterior supporting the substrates (30), the endless conveyor belt is conducted over reversing rollers embodied as insulators (17.3), and the endless conveyor belt (25) is movable between the reversing rollers on the insulator (17.1) covering a transport framework.

19. The electrophotographic printing device in accordance with claim 1, wherein the charging device (16, 18) is designed as area coronas which extend over an entire width of a surface of the substrate (30) extending transversely to the transport direction, and at least partly over the surface of the substrate (30) oriented in the transport direction.

20. The electrophotographic printing device in accordance with claim 19, wherein the area coronas contain electrically non-conductive corona wire holders (16.1, 18.1) which are stretched in grounded housings (16.3, 16.4, or 18.3, 18.4) and on which several side-by-side arranged electrically conductive corona wires (16.2, 18.2) are supported, which have a uniform charge potential ($U_C$) with a counter-potential that is grounded.

21. The electrophotographic printing device in accordance with claim 1, wherein the insulator (17, 17.1 . . . 17.n, 17.3) is of at least one of a highly impact-resistant plastic, a polyamide, a polyimide, an epoxy resin, a resin-impregnated paper, and a bakelite.

22. The electrophotographic printing device in accordance with claim 1, wherein the insulator (17, 17.1 . . . 17.n, 17.3) is of an abrasion-resistant and mechanically stressable ceramic or silicate material.

23. The electrophotographic printing device in accordance with claim 1, wherein the electrically conductive layer (31) is of at least one of an aluminum foil, a copper foil, a thin sheet metal, a steel foil and plastic foils of polyurethane, silicon, and the like, which are electrically conductive, and which have an electrical conductivity of less than 1000 $\Omega/cm^2$.

24. The electrophotographic printing device in accordance with claim 1, wherein an epoxy resin plate coated with copper is used as the insulator (17) and the electrically conductive layer (31).

25. The electrophotographic printing device in accordance with claim 1, wherein the electrically conductive layer (31) between the substrate (30) and the insulator (17) is chargeable to a potential voltage of 1 to 10 kV.

26. The electrophotographic printing device in accordance with claim 1, wherein the electrically conductive layer (31) is embodied as an elastic endless belt made of one of a conductive material and a metallized surface.

27. The electrophotographic printing device in accordance with claim 1, wherein the substrate (30) is receivable in an insulating mold (35.1) having rims (35.2) with a receptacle that supports a conductive layer (36) which can be charged to the field voltage ($U_F$) by brushes (37).

* * * * *

UNITED STATES PATENT AND TRADEMARK OFFICE

CERTIFICATE OF CORRECTION

PATENT NO. : 7,123,868 B2
APPLICATION NO. : 10/487389
DATED : October 17, 2006
INVENTOR(S) : Bernd Schultheis et al.

It is certified that error appears in the above-identified patent and that said Letters Patent is hereby corrected as shown below:

On the Title Page, Item number 75, Inventor, delete "Herkersdorf" and insert --Mittelhof-- in its place.

Signed and Sealed this

Eleventh Day of May, 2010

David J. Kappos

David J. Kappos
*Director of the United States Patent and Trademark Office*